US005572180A

United States Patent [19]

Huang et al.

[11] Patent Number: 5,572,180

[45] Date of Patent: Nov. 5, 1996

[54] SURFACE MOUNTABLE INDUCTOR

[75] Inventors: Philip M. Huang, Plantation; John J. Neumann, North Lauderdale; John L. Holley, Jr., Lake Worth, all of Fla.

[73] Assignee: Motorola, Inc., Schaumburg, Ill.

[21] Appl. No.: 559,353

[22] Filed: Nov. 16, 1995

[51] Int. Cl.[6] ..... H01F 41/04

[52] U.S. Cl. ..... 336/200; 336/184; 336/192; 336/232

[58] Field of Search ..... 336/200, 184, 336/192, 232

[56] References Cited

U.S. PATENT DOCUMENTS

| | | | |
|---|---|---|---|
| 3,660,791 | 5/1972 | Davis | 336/192 |
| 3,765,082 | 10/1973 | Zyetz | 29/602 |
| 4,322,698 | 3/1982 | Takahashi et al. | 336/184 |
| 4,717,901 | 1/1988 | Autenrieth et al. | 336/83 |
| 4,751,481 | 6/1988 | Guzik et al. | 333/222 |
| 4,769,900 | 9/1988 | Morinaga et al. | 29/606 |
| 5,055,816 | 10/1991 | Altman et al. | 336/200 |
| 5,294,749 | 3/1994 | Lauder et al. | 174/52.2 |
| 5,392,019 | 2/1995 | Ohkubo | 336/200 |

FOREIGN PATENT DOCUMENTS

| | | | |
|---|---|---|---|
| 4-106909 | 8/1992 | Japan | H01F 17/00 |

*Primary Examiner*—Michael L. Gellner
*Assistant Examiner*—G. R. Lord
*Attorney, Agent, or Firm*—Barbara R. Doutre

[57] ABSTRACT

A multi-tapped surface mount inductor (300) providing high quality factor (Q) and high inductance is capable of being surface mounted on any of its four sides. An inner substrate layer(s) (322) is provided with metallized patterns (328, 332) and vias (336) to form a multi-turn coil. The inner substrate layer (322) is then sandwiched between first and second outer substrate layers (324, 326) to form a six sided structure. Tapped element(s) (304) can be tapped off the multi-turn coil in increments of a quarter turn or less to provide a multi-tapped surface mount inductor capable of being mounted an any of its' four side surfaces (310, 312, 314, 316). When tapped element(s) (204) are tapped symmetrically between the input/output ends (214, 216), the surface mount inductor (200) may interchange its' input/output ends (214, 216) making the component surface mountable in eight different positions.

25 Claims, 8 Drawing Sheets

SURFACE MOUNTABLE INDUCTOR

TECHNICAL FIELD

This invention relates in general to surface mountable electronic components and more specifically to surface mount inductors.

BACKGROUND

In modern portable wireless product designs, there is a continued effort to reduce size and improve the performance of radio frequency (RF) circuit components. One such component is the surface mount inductor which can be used as a resonator, as an RF choke, as a component in a hybrid filter, as well as various other applications known in the art. Modern manufacturing techniques require that the majority, if not all, of the electronic components found in an assembly be capable of being surface mounted in order to decrease manufacturing cycle time. Surface mount inductors can be formed using one of several known technologies including molded electronic component technology, wire wound chip inductor technology, and printed circuit board technology.

Molded inductors are typically formed of a helical wire coil molded over with any of a number of suitable thermoplastic materials, such as a polyetherimide which has a 10% fiberglass content, this material is sold under the tradename ULTEM 2100 by General Electric Company. Molded inductors are typically formed using a double shot molding or insert molding technique that provides a surface mountable part that can be packaged using tape and reel, which allows for robotic parts placement. A disadvantage associated with molded inductors is that the ends of the formed wires are still exposed in order to make electrical contact with an electronic circuit board. Controlling the extent to which the wires extend from the main body can be a difficult tolerance specification to maintain. It is also important that the main body of the coil be soldered down as close to the circuit board as possible in order to reduce microphonics. It would be a benefit to have a surface mount inductor that had no extending wires which would allow it to be soldered flush against a circuit board.

Another issue associated with today's molded inductors is that the plastics used tend to break down at temperatures above 220° Centigrade. (° C.). This can be an issue in manufacturing processes that need high temperatures (usually in the range of 230° C.–240° C.) to do a reliable reflow of electrical components on a substrate. A surface mount inductor that could be reflowed at high temperatures without deformation or breakdown would improve the reliability of the component as well as ensure an improved electrical contact between the component and the circuit board.

Another disadvantage associated with molded inductors is that multiple process steps are involved in the formation of these coils including winding the wire, performing the overmolding process, and a thin film plating procedure. These multiple processes are usually performed at different manufacturing facilities. Using a multi-process such as this can be expensive and drive up manufacturing costs. It would be desirable to form a surface mount inductor using a single process.

Other surface mount inductors known in the art include multiple "turn" and spiral patterned inductors formed on substrates, such as fire retarding glass epoxy (FR4) or ceramics. A disadvantage associated with today's spiral/multi-turn inductors is that they tend to have low inductance values and low quality factor (Q). In order to achieve high Q (approximately >100) and high inductance (approximately >10 nanohenries) the form factor of these components becomes too large for portable product applications. Ceramic substrates are costly and do not lend themselves well to being stacked due to alignment issues. Multilayer ceramic inductors are also prone to dendrite growth and silver migration. While substrates such as FR4 can be stacked, the Q tends to decrease as the part size increases. High Q components are critical to meeting high performance product specifications. A patterned inductor having high inductance values and high Q would be beneficial in terms of meeting electrical specifications.

While most surface mount coils can be tape and reeled, they still require proper orientation as there is typically only one "surface mountable" side. Thus, wire wound chip inductors require that a turn be completed down to the surface mountable side which limits the range of available inductor values. It would be a further advantage if a surface mountable inductor could provide high Q, high inductance values in conjunction with smaller incremental tuning ranges. A surface mount inductor that is surface mountable across all sides would make the component easier to package as well as easier to place robotically.

Accordingly, there is a need for an improved surface mount inductor that can be manufactured using a single process technique without the use of formed wires. It would be a benefit if such a part could be surface mountable from all sides in order to ease packaging and component placement. It would be a further benefit to provide a surface mount inductor that provides smaller incremental tuning ranges.

DETAILED DESCRIPTION OF THE PREFERRED EMBODIMENT

Figure 1:
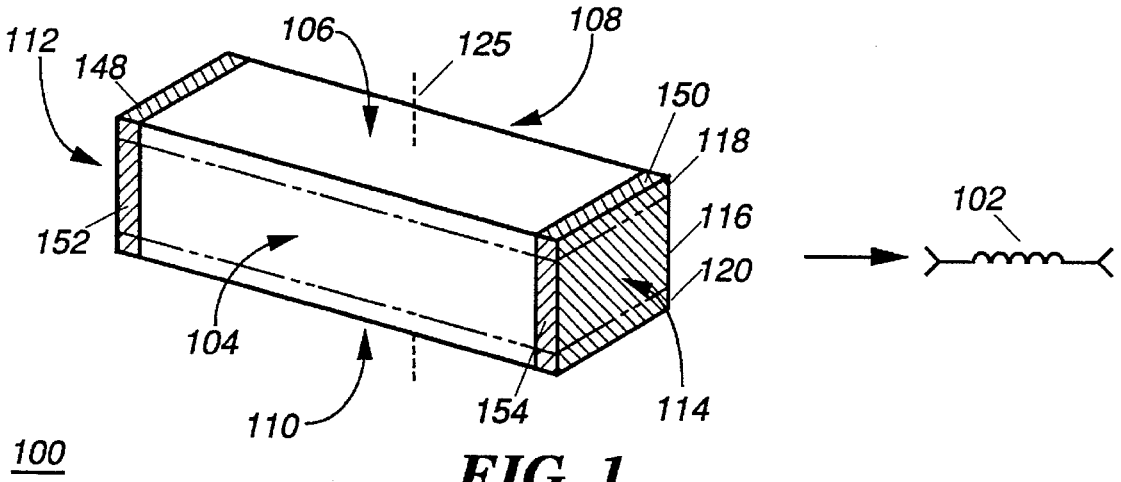
FIG. 1 shows a surface mountable inductor in accordance with the present invention.

FIG. 1 shows a first embodiment of a surface mountable inductor 100 in accordance with the present invention and its equivalent circuit model 102. In accordance with the present invention, surface mount inductor 100 is a six sided structure including first, second, third, and fourth side surfaces 104, 106, 108, and 110 respectively and first and second end surfaces 112, 114 respectively. First and third side surfaces will also be referred to as side walls 104, 108. In accordance with the preferred embodiment of the invention, surface mount inductor 100 is capable of being mounted on any of its four side surfaces 104, 106, 108, and 110 between first and second ends 112, 114. First and second ends 112, 114 operate as input and output ports of the surface mount inductor 100 and in this first embodiment of the invention are interchangeable. Thus, the surface mount inductor 100, in accordance with the first embodiment of the invention, has a total of eight different positions with which it can be mounted.

Surface mount inductor 100 is formed from a plurality of stacked substrate layers including an inner substrate layer 116 sandwiched between first and second outer substrate layers 118, 120 respectively. In accordance with the preferred embodiment of the invention, the material of the inner substrate layer 116 and first and second outer substrate layers 118, 120 is a high temperature material which inhibits deformation in the Z-axis 125. The Z-axis 125 is illustrated as a dashed line running perpendicular to the to the substrate surface. A composition of polytetrafluoroethylene (PTFE) reinforced with woven glass and sold by Arlon, Inc. under the brand name "CLTE" or a glass filled PTFE composition sold by Rogers, Inc. sold under the number "3003" are examples of such materials. PTFE is commonly known as TEFLON®, a trademark of E. I. DuPont DeNemours & Co. The compositions described above tend to have low loss tangents of approximately $\leqq 0.005$. These high temperature low loss tangent materials have a reduced coefficient of thermal expansion in the Z-axis 125 in the approximate range of 24–35 parts per million (ppm) per degrees Celsius. A material which inhibits expansion in the Z-axis at high temperatures (temperatures above 220° C. and below 400° C.) provides improved through-hole reliability. High temperature solder typically reflows at temperatures in the approximate range of 230°–240° C. Thus, high temperature solder can be reflowed about the surface mount inductor 100 described by the invention without deformation problems. High quality factor (Q) and high inductance component structures can now be created that are surface mountable in a variety of configurations, such as the embodiment shown in FIG. 1, to be described herein.

Figure 2:
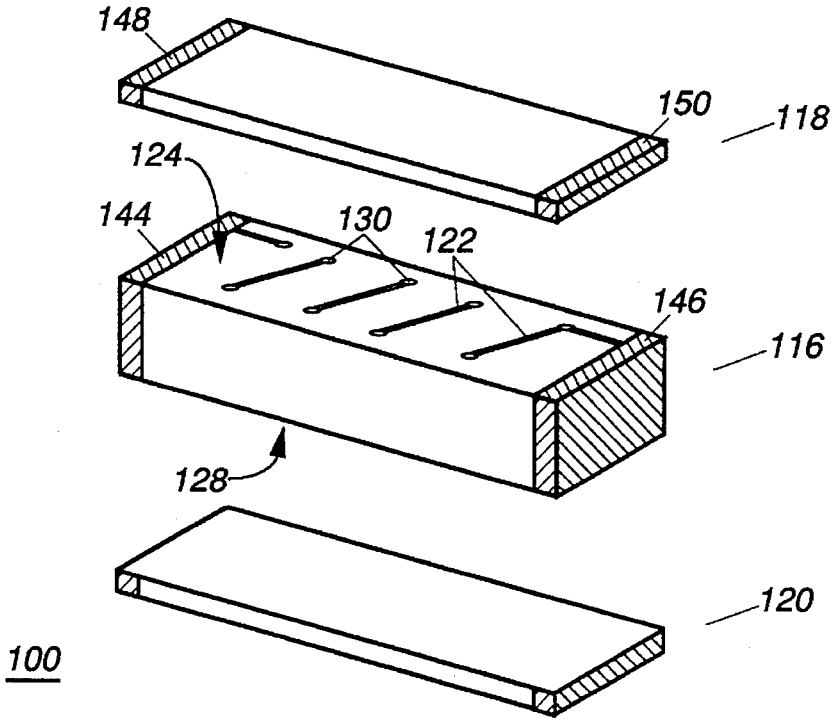
FIG. 2 shows an exploded view of the surface mountable inductor of FIG. 1 in accordance with the present invention.

FIG. 2 shows an exploded view of the surface mount inductor 100 which includes inner substrate layer 116 and first and second outer substrate layers 118, 120 respectively. The inner substrate layer 116 provides the center core for the surface mountable inductor 100 and includes a first metalization pattern 122 disposed as traces upon a first surface 124 and a second metalization pattern 126 (shown as dashed lines in FIG. 3) disposed upon an opposing second surface 128. First and second opposing surfaces 124, 128 including metalization patterns 122, 126 are the surfaces sandwiched between the first and second outer substrate layers 118, 120 respectively.

Figure 3:
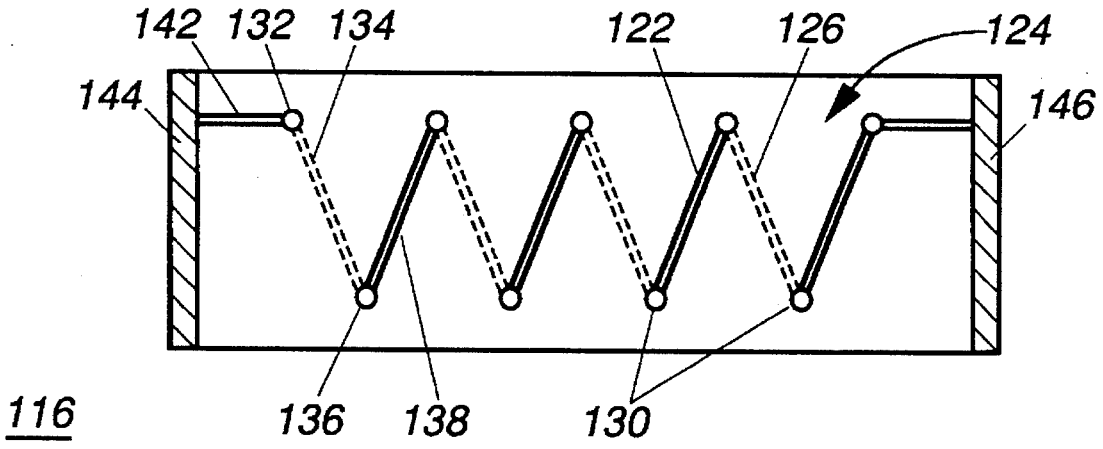
FIG. 3 shows a top view on an inner substrate layer shown in FIG. 2 in accordance with the present invention.

The first and second metalization patterns 122, 126 are interconnected between the first and second opposed surfaces 124, 128 through plated through-holes 130, also known as vias. FIG. 3 shows a top view of the inner substrate layer 116 in accordance with the invention. First and second metalization patterns 122, 126 are interconnected through vias 130 in a manner to be described herein to form windings that produce a multi-turn or multi-loop coil between interchangeable first and second ends 112, 114.

To create inductance in a given surface area, multiple turns or coupling loops are produced by serially coupling the plurality of plated through-holes 130 through the inner substrate layer 116. Continuing to refer to FIGS. 2 and 3, a first turn is formed with via 132, trace 134, via 136, and trace 138. The turns or windings follow a similar pattern of interconnection forming a multi-turn coil incremented in quarter turns. The first turn is coupled to a first metallized pad 144 through coupling trace 142. A final turn of the inductor is similarly formed and coupled to a second metallized pad 146.

To create input/output ports a series of metallized pads are coupled together at each end of the component. The second side surface 106 includes metallized pads 148, 150 and similar pads (not shown) are disposed on the fourth side surface 110. Side wall 104 includes metallized pads 152, 154 and similar metallized pads (not shown) are disposed on side wall 108. The metallized pads 144, 148, 152, and (adjacent pads on surfaces 108, 110) couple together with first end 112 (also plated) to form the input/output port having four plated sides and a plated end. The metallized pads 146, 150, 154 and (adjacent pads on surfaces 108, 110) couple to second end 114 (also plated) to form the other input/output port having four plated sides and a plated end. The process by which the input/output ports and metalization patterns are formed is described below.

Through-holes 130 are formed in inner substrate layer 116 using conventional drilling or punching techniques and then plated using conventional plating techniques. To create the metalization patterns 122, 126 and metallized pads 144, 146 a print and etch is then performed on the inner substrate layer 116. In this embodiment of the invention, a double sided print and etch is performed to produce the metalization patterns 122, 126 and pads 144, 146. Next, the inner substrate layer 116 is sandwiched between two layers of bonding film, and the outer substrate layers 118, 120 are added to either side of the patterned inner layer. The entire structure is then laminated together into a single package. Next, conventional drill and route techniques are performed on the first and third side walls 104, 108 adjacent to the metallized pads 148, 150, to create channels within which to plate. Finally, another plating process is performed where the routed portions of side walls 104, 108 are plated to create the metallized pads 152, 154 and similar pads (not shown) on side wall 108. The end surfaces 112, 114 are preferably plated. Thus, the input and output ports are plated about all four side surfaces of the component. The plating process used is preferably a plate up process of copper and gold, also referred to as a pattern plate. Thus, the problems of dendrite growth and silver migration associated with prior art ceramic inductors are no longer issues. Optional through-holes (not shown) can also be drilled through the metalization pads 148, 150 and plated to provide an improved electrical interconnect between the layers. The end surfaces 112, 114, while preferably plated for improved electrical contact, may also be left unplated, leaving the metallized pads disposed on the four surfaces (148, 152, with adjacent pads not shown and metallized pads 150, 154, with adjacent pads not shown) to make the electrical contact.

In accordance with the invention, a wide variety of structure sizes can be implemented with the preferred structure being dimensioned to be substantially symmetric about its four side surfaces 104, 106, 108, and 110. This allows for easy robotic placement of the component. The inner substrate layer 116 can be formed of a relatively thick single layer as compared to the outer substrate layers if desired. To increase inductance, the electrical length (i.e. the number of turns) can be increased about the larger core without having to decrease the width of the trace. High inductance and high Q surface mount inductors can be achieved with the surface mount inductor described by the invention.

A sample of inductors were formed in accordance with the first embodiment of the invention with the following approximate dimensions: a length of 0.66 centimeters (cm), a width of 0.406 cm, and a height of 0.381 cm with a core height of 0.157 cm. All layers were formed with the PTFE reinforced with woven glass, as previously described, with gold over copper plating. Inductance values of around 20 nanohenries with an unloaded Q of approximately 150 were measured in components made with the above mentioned parameters. The thickness of the center core is preferably achieved using a single piece of high temperature low loss tangent material, however substantially the same effect can be achieved (at a more costly price) using multiple stacked layers of the same material for the center core if desired.

Figure 4:
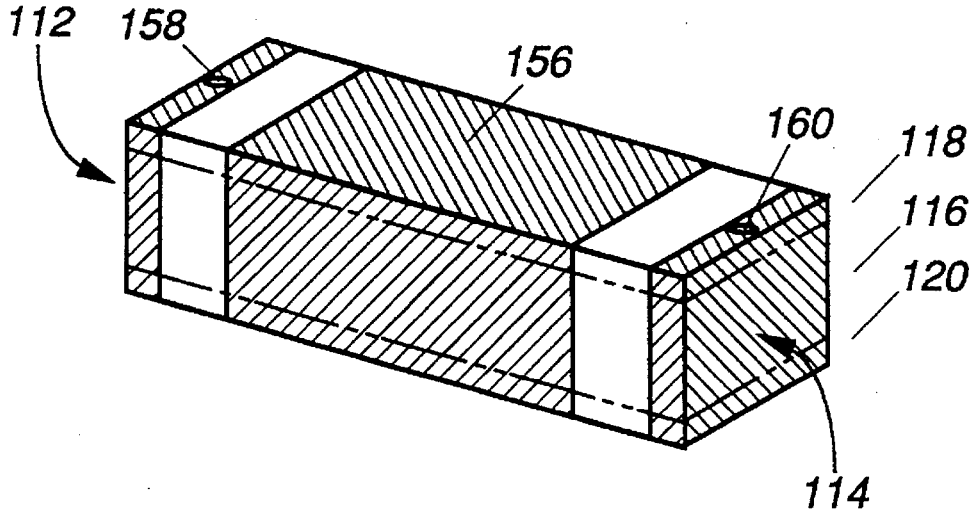
FIG. 4 shows a shielded version of the surface mountable inductor of FIG. 1.

FIG. 4 shows a shielded version the surface mountable inductor 100 in accordance with the present invention. Shield 156 is preferably formed of plated metal and preferably disposed about all four side surfaces 104, 106, 108, and 110 to allow the component to remain solderable in all eight configurations. One, skilled in the art realizes that fewer shielded sides may be used, however, the number of solderable sides is then reduced. Shield 156 can be soldered to ground of an electronic circuit board to provide radio frequency (RF) shielding for surface mount inductor 100. FIG. 4 further illustrates the options of plated through-holes 158, 160 through the plurality of substrate layers 116, 118, 120 for increased electrical reliability.

Figure 5:
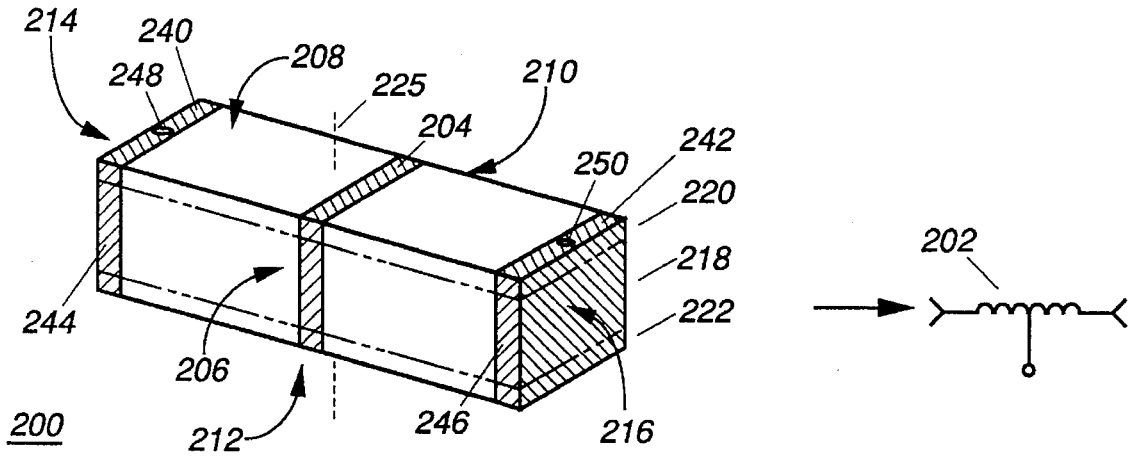
FIG. 5 shows a second embodiment of the surface mountable inductor in accordance with the present invention.

FIG. 5 shows a second embodiment of a surface mountable inductor 200 in accordance with the present invention and its equivalent circuit model 202. In accordance with the second embodiment, surface mount inductor 200 includes a center tap element 204. Surface mount inductor 200 will also be referred to as center tapped inductor 200. In accordance with the invention, center tapped inductor 200 is a six sided structure capable of being surface mounted on any of its first, second third, or fourth side surfaces 206, 208, 210, 212 respectively between interchangeable first and second ends 214, 216. First and second ends 214, 216 operate as input and output ports of the center tapped inductor 200 and in this second embodiment of the invention are interchangeable. Thus, the center tapped inductor 200 in accordance with the second embodiment of the invention has a total of eight different positions with which it can be mounted. Center tapped inductor 200 is formed from a plurality of stacked substrate layers including an inner substrate layer 218 sandwiched between first and second outer substrate layers 220, 222 respectively. In accordance with the invention, the material of the inner substrate layer 2 18 and first and second outer substrate layers 220, 222 is a high temperature material with low loss tangent that inhibits expansion in the Z-axis 225 over temperature.

Figure 6:
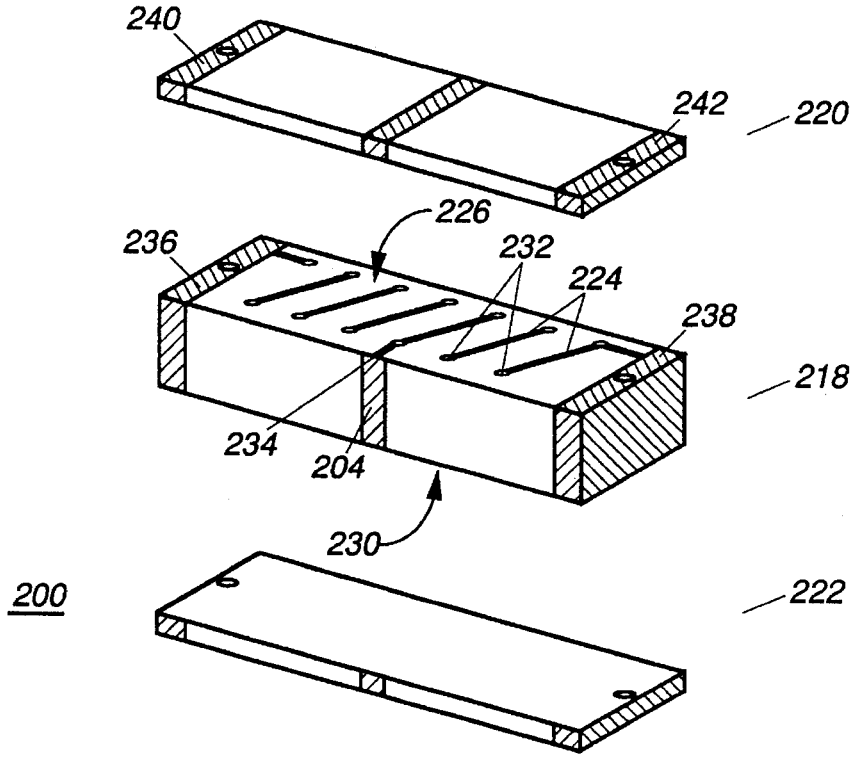
FIG. 6 shows an exploded view of the surface mountable inductor of FIG. 5 in accordance with the present invention.

FIG. 6 shows an exploded view of center tapped inductor 200 which includes inner substrate layer 218 and first and second outer substrate layers 220, 222 respectively. Inner substrate layer 2 18 includes a first metalization pattern 224 disposed upon a first surface 226 while a second metalization pattern 228 (shown as dashed lines in FIG. 7) is disposed upon a second opposing surface 230. First and second opposing surfaces 226, 230 having metalization patterns 224, 228 are the surfaces sandwiched between the outer substrate layers 220, 222 respectively.

Figure 7:
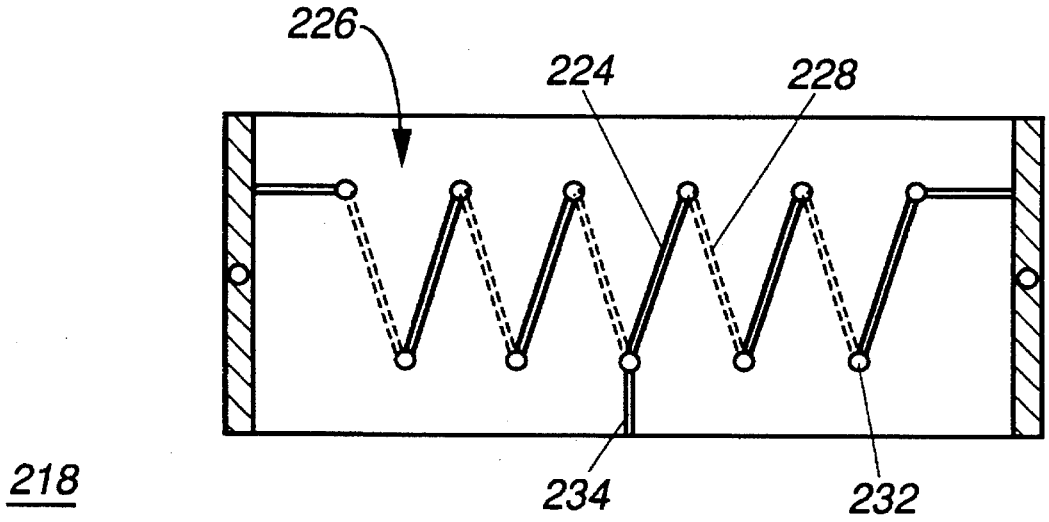
FIG. 7 shows a top view on an inner substrate layer shown in FIG. 6 in accordance with the present invention.

The metalization patterns 224, 228 are interconnected between the first and second opposed surfaces 226, 230 through plated through-holes, also known as vias, 232. FIG. 7 shows a top view of the inner substrate layer 218 in accordance with second embodiment of the invention. Metalization patterns 224, 228 are interconnected through vias 232 in a manner described in the previous embodiment to form windings that produce a multi-turn or multi-loop coil between the interchangeable input/output ends 214, 216. In accordance with the second embodiment of the invention, inner substrate layer 218 includes a metallized trace 234 which provides a tap point to the center of the windings. The tap point 234 couples to tap element 204 to provide a conductive center tap element along the four side surfaces 206, 208, 210, and 212 of the six sided structure.

Known plate and etch processes are preferably used to create the metalization patterns 224, 228, metallized trace 234 and input/output pads 236, 238 of the inner substrate layer 218. Plate and etch processes are also used to create the input/output pads 240, 242 and portions of the tap element 204 disposed on the outer substrate layer 220 and similarly though not shown on the bottom of outer substrate layer 222. Once the substrates are laminated into a single structure, side routing can be used on side walls 206, 210 to create a channel within which tapped element 204 can be plated. Metallized pads 244, 246 on first side surface 206 and similar pads (not shown) on third side surface 210 are similarly routed and plated. Drill holes 248, 250 are preferably drilled through substrate layers 218, 220, 222 at the input/output pads 240, 242 and plated for improved reliability. End surfaces 214, 216 are also preferably plated.

Figure 8:
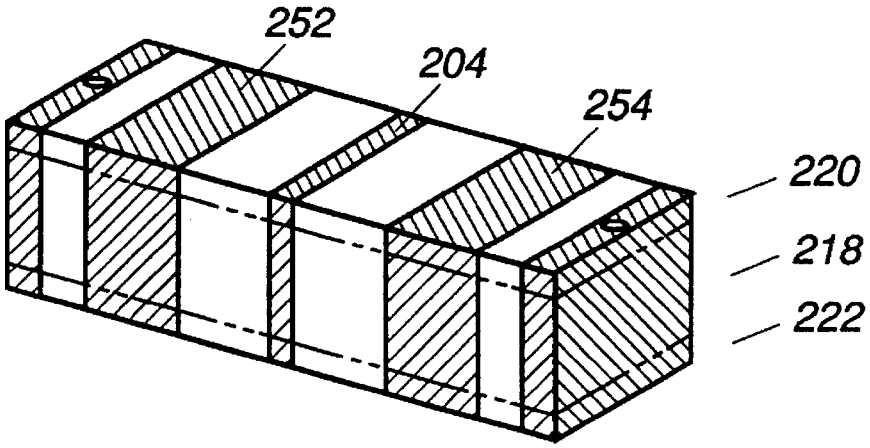
FIG. 8 shows a shielded version of the surface mountable inductor of FIG. 5.

FIG. 8 shows a shielded version of the center tapped surface mountable inductor 200 in accordance with the invention. First shielding portion 252 is disposed about the four side surfaces 206, 208, 210, and 212 between the first end 214 and the tap element 204. Similarly, second shielding portion 254 is disposed about the four side surfaces 206, 208, 210, and 212 between the second end 214 and the tap element 204. Shielding portions 252, 254 can be soldered to ground of an electronic circuit board to provide RF shielding of center tapped inductor 200. The shielding portions 252, 254 which are disposed on the outer substrate layers 220, 222 can be created during the plate and etch process of the outer substrate layers. The shielding portions 252, 254 which are disposed on the side walls 206, 210 can be formed during the side routing and plating process of the entire structure. The tapped surface mountable inductor 200 described by the invention is particularly useful in voltage controlled oscillator circuits, such as Hartley oscillator configurations, where a tapped resonator is required.

While the turns ratio shown and described in FIG. 5 is a 2:1 turn ratio, tapped at the center, the surface mount inductor may alternatively be tapped at another (non-centered) turn and still have the advantage of being solderable on any of its four side surfaces 206, 208, 210, 212 with orientation only being required between the first and second ends 214, 216.

Figure 9:
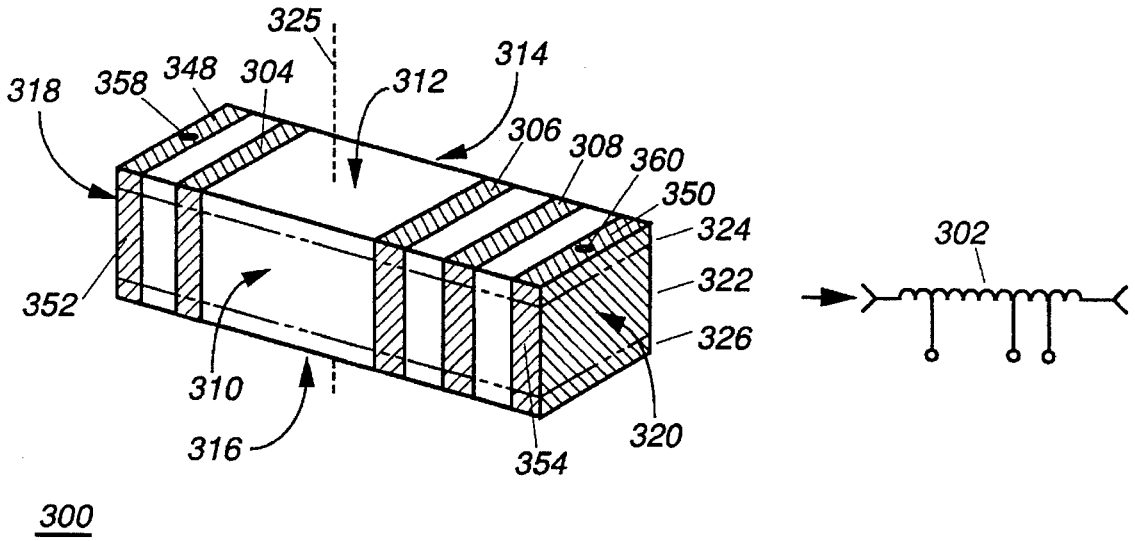
FIG. 9 shows a third embodiment of a surface mountable inductor in accordance with the present invention.

FIG. 9 shows a third embodiment of a surface mountable inductor 300 in accordance with the present invention and its equivalent circuit model 302. In accordance with the third embodiment, surface mount inductor 300 includes multi-tapped elements 304, 306, and 308. Surface mount inductor 300 will also be referred to as multi-tap inductor 300. In accordance with the invention, multi-tap inductor 300 is a six sided structure capable of being surface mounted on any of its four sides 310, 312, 314, and 316 between first and second ends 318, 320. First and second ends 318, 320 operate as input and output ports of the multi-tapped inductor 300. Here again, the multi-tap inductor 300 is surface mountable on any of its four side surfaces 310, 312, 314, and 316, however, orientation of the first and second ends 318, 320 is required due to the different non-symmetric tap points about the coil. Thus, the multi-tapped inductor 300 in accordance with the third embodiment of the invention has a total of four different positions with which it can be mounted. Multi-tapped inductor 300 is formed from a plurality of stacked substrate layers including an inner substrate layer 322 sandwiched between first and second outer substrate layers 322, 324 respectively. In accordance with the preferred embodiment of the invention, the material of the inner substrate layer 322 and the first and second outer substrate layers 324, 326 is a high temperature material which inhibits expansion in the Z-axis 325 and has a low loss tangent.

Figure 10:
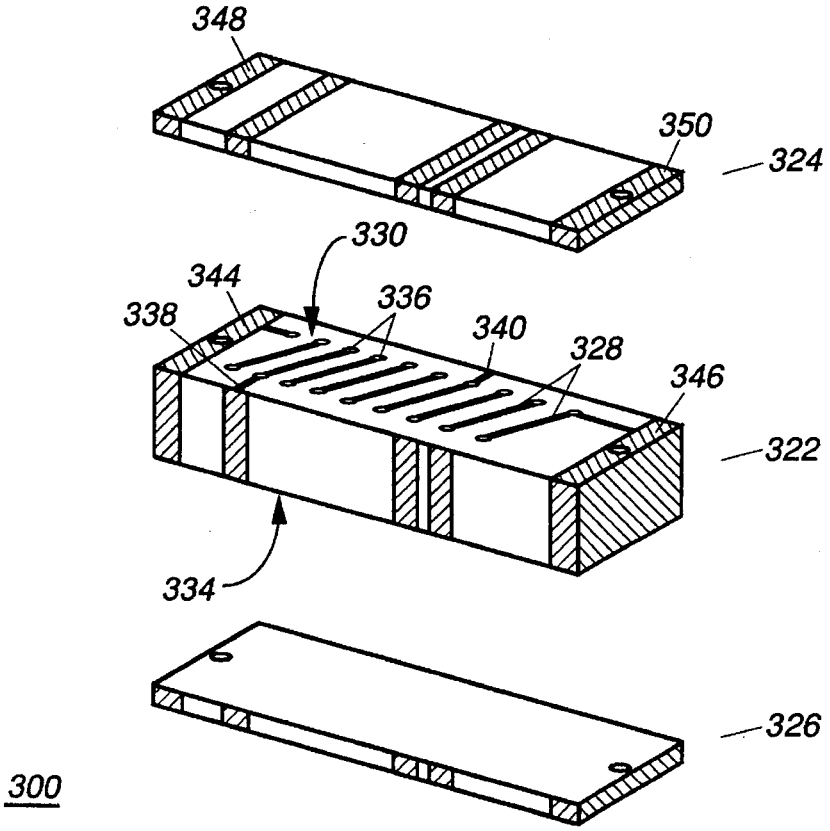
FIG. 10 shows an exploded view of the surface mountable inductor of FIG. 9 in accordance with the present invention.

FIG. 10 shows an exploded view of multi-tapped inductor 300 which includes the inner substrate layer 322 and first and second outer substrate layers 324, 326 respectively. Inner substrate layer 322 includes a first metalization pattern 328 disposed upon a first surface 330 while a second metalization pattern 332 (shown as dashed lines in FIG. 11) is disposed upon a second opposing surface 334. First and second opposing surfaces 330, 334 having metalization patterns 328, 332 are the surfaces that become sandwiched between the outer substrate layers 324, 326 respectively.

Figure 11:
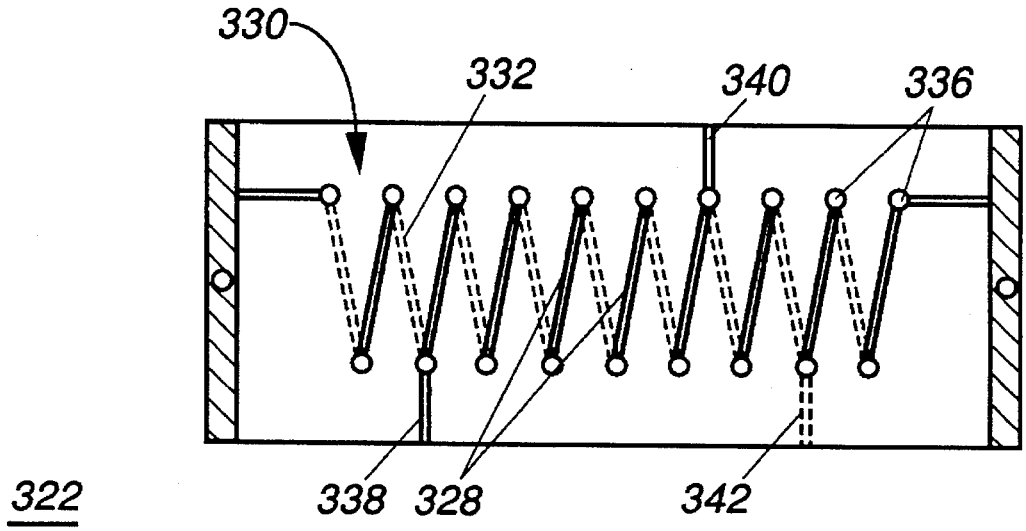
FIG. 11 shows a top view on an inner substrate layer shown in FIG. 10 in accordance with the present invention.

The first and second metalization patterns 328, 332 are interconnected between the first and second opposing surfaces 330, 334 with plated through-holes, also known as vias, 336. FIG. 11 shows a top view of the inner substrate layer 322 in accordance with the third embodiment of the invention. Metalization patterns 328, 332 are interconnected through vias 336 in a manner previously described to form windings that produce a multi-turn or multi-loop coil between first and second ends 318, 320. Inner substrate layer 322 includes first and second metallized traces 338, 340 being tapped out from vias on its first opposed surface 330 to tapped elements 304, 306 respectively. A third metallized trace 342 is shown (FIG. 11 dashed lines) being tapped out from a via on the second opposed surface 334 to tapped element 308. Thus, the multi-tapped inductor 300 can provide a variety of tap points from either of inner layer's 322 opposed surfaces 330, 334 having metalization patterns. By tapping off the vias of the first and second metallized patterns 328, 332, tapped elements can now be taken from any quarter turn of the coil windings. This is a significant improvement over existing surface mount coils. By being able to tap off quarter increments of the coil, more finally tuned inductor values can be achieved. The effect of running the tapped element along all four side surfaces 310, 312, 314, and 316 has little impact on inductance value and provides the further advantage of allowing the component to be surface mountable on about all four side surfaces.

Known plate and etch processes are preferably used to create the metalization patterns 328, 332, tapped traces 338, 340, 342, and input and output pads 344, 346 of the inner substrate layer 320. Plate and etch process are also used to create the input and output pads 348, 350 and portions of the tapped elements 304, 306, 308 on the outer substrate layer 324 and similarly though not shown on outer substrate layer 326. Once the substrates are laminated together into a single structure, side routing is used to create channels adjacent to tapped traces 338, 340, 342 and within which tapped elements 304, 306, and 308 can be plated. Side routing and plating is also used to create the input and output pads 352, 354 on side wall 310 and similarly though not shown on side wall 314. Drill holes 358, 360 are preferably drilled through all substrate layers at the input/output pads 348, 350 for increased reliability. End surfaces 3 18, 320 are also preferably plated for improved electrical contact.

Figure 12:
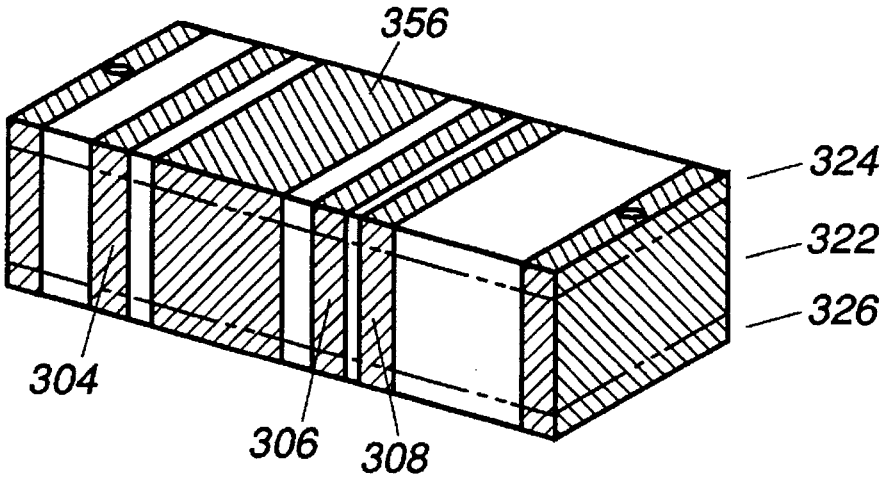
FIG. 12 shows a shielded version of the surface mountable inductor of FIG. 9.

FIG. 12 shows a shielded version of the multi-tapped surface mountable inductor 300 in accordance with the invention. Shield 356 is preferably disposed about the four side surfaces 310, 312, 314, and 316 between tapped elements 304, 306. Shield 356 can be soldered to ground of an electronic circuit board to provide RF shielding of a predetermined portion of the multi-tapped inductor 300. Again, the shielding is preferably provided to all four side surfaces 310, 312, 314, and 316 so that the component remains surface mountable about each side. The shielding 356 can be plated during the plate and etch process of the outer substrate layers 324, 326 and during the side route and plate process of side walls 310, 314 of the completed structure. More or less shielding can be used depending on the number of tapped elements that are brought out to the outer perimeter of the component.

Figure 13:
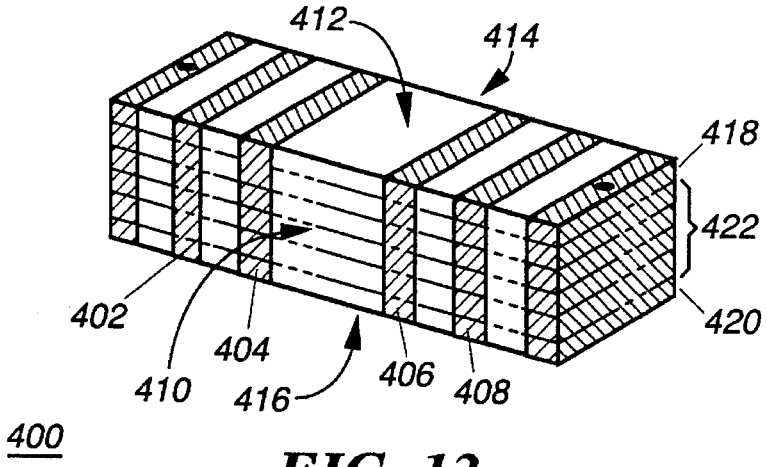
FIG. 13 shows a fourth embodiment of a surface mountable inductor in accordance with the present invention.
Figure 14:
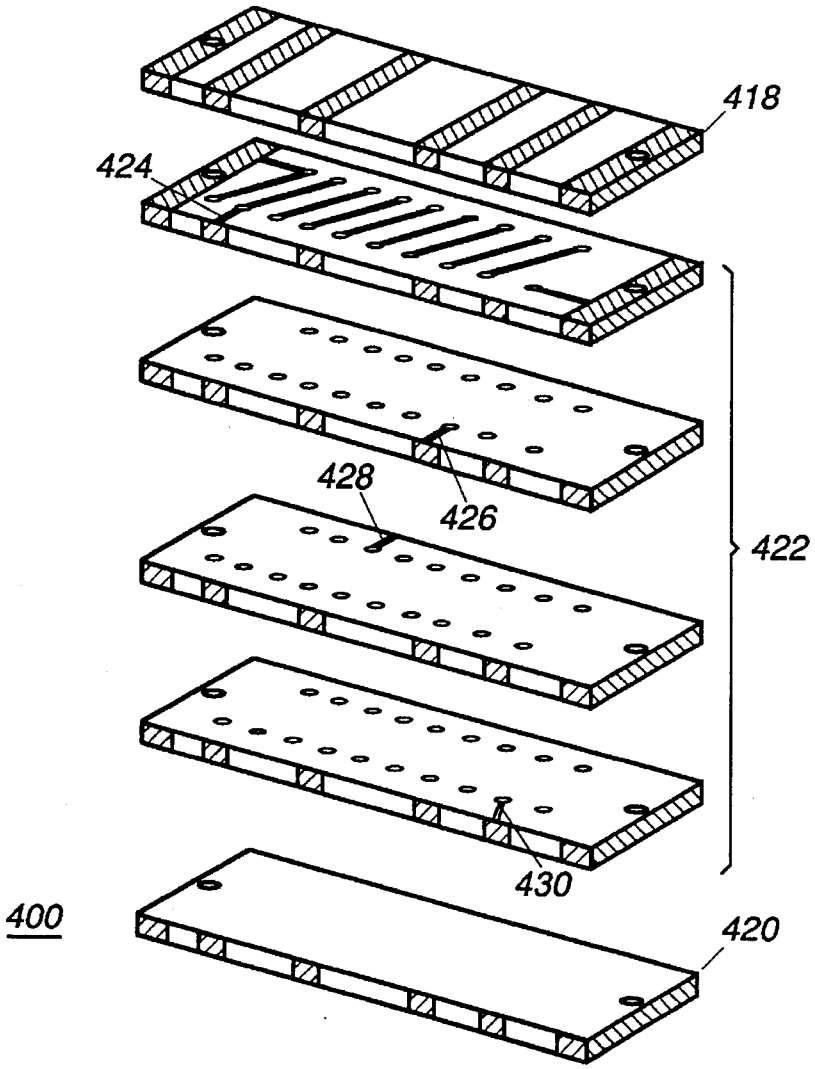
FIG. 14 shows an exploded view of the surface mountable inductor of FIG. 13 in accordance with the present invention.

FIG. 13 shows a fourth embodiment of a surface mountable inductor 400 in accordance with the present invention. In accordance with this fourth embodiment, surface mount inductor 400 includes a plurality of tapped elements 402, 404, 406, and 408 and is surface mountable on all four side surfaces 410, 412,414, and 416. Surface mount inductor 400 is formed of two outer substrate layers 418 and 420 sandwiched between a center core 422. FIG. 14 shows an exploded view of the surface mount inductor of FIG. 13 in accordance with this fourth embodiment of the invention. The center core 422 is formed using a plurality of stacked substrate layers. Tap points 424, 426, 428, and 430 can thus be taken from any one of the center core's 422 inner layers. Forming the center core 422 using a plurality of stacked substrate layers provides the advantage of being able to tap inductor 400 in smaller increments than the previously described quarter turn increments. Similar materials and similar plating, etching, bonding, and side routing techniques to those previously described can be used to form the surface mountable inductor 400. Similar shielding (not shown) can also be added to predetermined portions of the surface mount inductor 400 in the manner previously described if desired.

Figure 15:
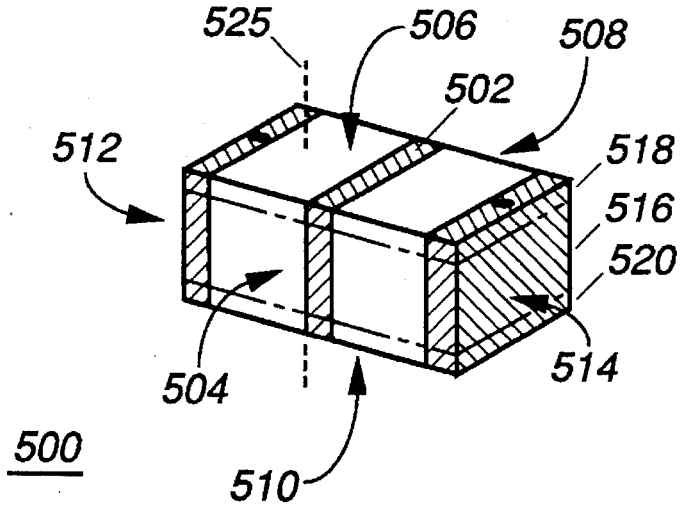
FIG. 15 shows another embodiment of the surface mountable inductor in accordance with the present invention.

FIG. 15 shows another embodiment of a surface mount inductor in accordance with the invention. In accordance with the invention, there is provided a single tap inductor 500 which is surface mountable on any of its' four side surfaces 504, 506, 508, and 510 between first and second ends 512 and 514. Single tap inductor 500 is formed from a plurality of stacked substrate layers including an inner substrate layer 516 sandwiched between first and second outer substrate layers 518, 520 respectively. In accordance with the invention, the material of the inner substrate layer 516 and the first and second outer substrate layers 518, 520 is a high temperature material which inhibits expansion in the Z-axis 525 over temperature and has a low loss tangent.

Figure 16:
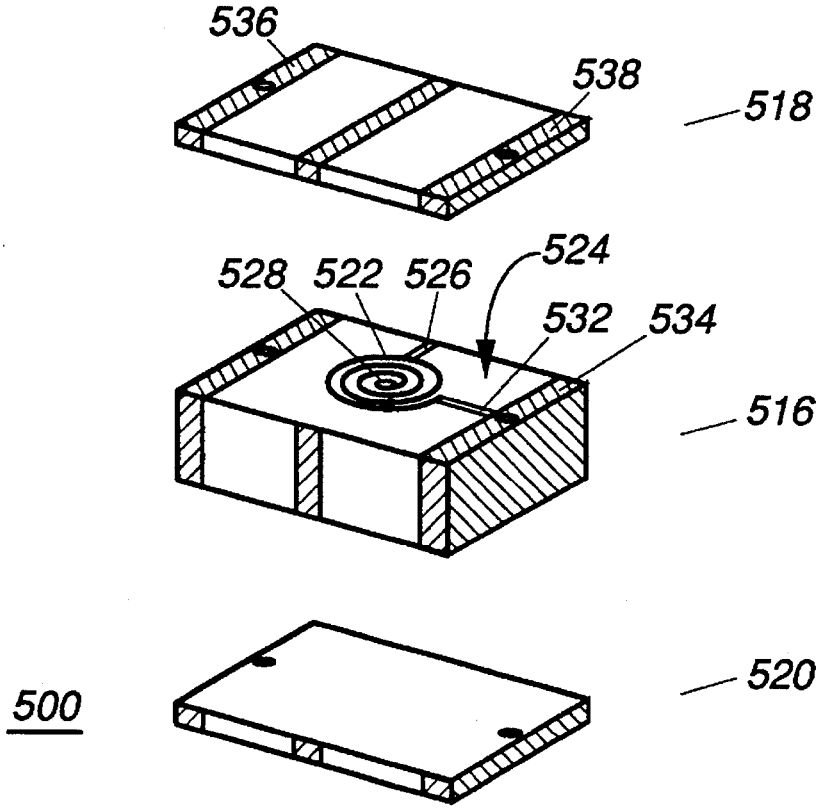
FIG. 16 shows an exploded view of the surface mountable inductor of FIG. 15 in accordance with the present invention.

FIG. 16 shows an exploded view of center tapped inductor 500 which includes the inner substrate layer 516 and first and second outer substrate layers 518, 520 respectively. In this embodiment, a spiral metallized pattern 522 is formed on a first surface 524 of the inner substrate layer 516 and tapped off with metallized trace 526. Similar plate and etch, lamination, and side routing and plating techniques previously described can be used to create the substrate layers and the completed inductor 500. Trace 526 is brought out to tapped element 502 to provide four sides upon which the component can be mounted. The center of the metallized spiral 522 is brought through a via 528 to a metallized trace (not shown) on the bottom of the inner substrate layer 516 which brings the spiral to an input pad (not shown) similar to the output pad shown on the top surface of inner substrate layer 516. The other end of the spiral 522 is coupled through trace 532 to a metallized output pad 534. Side walls 504, 508 are routed and plated as previously described to provide the portion of the tapped element 502 which resides on these surfaces. First and second ends 512, 514 are preferably plated. Drill holes are preferably drilled through the substrate layers of the completed structure at input pad 536 and output pad 538 then plated for improved electrical contact between the layers.

Through the use of vias and selective plating as previously described, multiple tap points can also be achieved with the spiral configuration. The same processes and techniques can be used to develop each of the previously described surface mount inductors. All the structures described consist primarily of a center core piece and two outer core pieces. The center core is preferably formed of a single thick piece of high temperature material, or stacked layers of the same. The print and etch is performed on the inner layer—either a double sided print and etch or in the case of the spiral a single side—to create the metalization patterns and traces. Holes are punched and plated through the inner layer. The inner layer is then sandwiched between two layers of laminate (not shown) and then the outer substrate layers are added to either side of the patterned inner layer and the entire structure is then laminated together into a single package. Next, the drill and route is performed along the side walls to create channels for input/output pads and tap elements. Finally, another plating process is performed where the routed portions (taps, shields, input, and outputs) are plated and the first and second end surfaces are plated. Because a single laminate process is used, the cost of producing the inductor structures described by the invention is significantly lower than prior art overmolded inductors.

Accordingly, there has been provided a surface mount inductor which can be formed in either a no tap, single tap (centered and non-centered) or multi-tapped configuration. Shielded and non-shielded versions the inductor structures described by the invention have also been described. All of the embodiments of the surface mount inductor described by the invention have been surface mountable on at least four side surfaces between the input/output ports. When symmetrical tapping or no tapping is used, the input/output ports become interchangeable and the need for any orientation is eliminated. These symmetrical components can be mounted in eight different positions. Thus, the surface mountable inductors described by the invention can easily be taped and reeled for improved robotic parts placement. Surface mount inductors formed in accordance with the present invention can be tapped in quarter turn increments or smaller increments depending on the structure of the surface mount inductor's inner core.

All of the surface mountable inductors described by the invention can be reflowed with high temperature solder without deformation. The single manufacturing process allows the surface mountable inductors described by the invention to be manufactured at a single processing facility which reduces manufacturing costs.

While the preferred embodiments of the invention have been illustrated and described, it will be clear that the invention is not so limited. Numerous modifications, changes, variations, substitutions, and equivalents will occur to those skilled in the art without departing from the spirit and scope of the present invention as defined by the appended claims.

What is claimed is:

1. A surface mountable inductor, comprising:

an inner substrate layer having first and second metalization patterns disposed upon first and second opposed surfaces, said first and second metalization patterns interconnected by vias to form an inductor having first and second ends;

first and second outer substrate layers disposed on the first and second opposed surfaces;

said inner substrate layer and first and second outer substrate layers forming a structure having first, second, third, and fourth side surfaces and first and second ends;

a metalized trace coupled to a center point of the first metalization pattern and extending about said first, second, third, and fourth side surfaces, said metalized trace providing a center tap element for the inductor; and said surface mountable inductor being mountable upon any of the first, second, third, and fourth side surfaces interchangeably between the first and second ends.

2. A surface mountable inductor as described in claim 1, further comprising first and second shielding portions, the first shielding portion disposed about the first, second, third, and fourth side surfaces between the first end and the center tap element, and the second shielding portion disposed about the first, second, third, and fourth side surfaces between the center tap element and the second end.

3. A surface mountable inductor as described in claim 2, wherein the surface mountable inductor-is capable of being reflowed with high temperature solder.

4. A surface mount inductor, comprising:

an inner substrate layer having first and second metalization patterns disposed upon first and second opposed surfaces, said first and second metalization patterns interconnected by vias to form a multi-turn coil;

first and second outer substrate layers disposed on the first and second opposed surfaces;

said inner substrate layer and first and second outer substrate layers forming a structure having first, second, third, and fourth side surfaces and first and second ends; and a plurality of metalized traces tapping off the vias and extending about the first, second, third, and fourth side surfaces to provide a multi-tapped inductor, said multi-tapped inductor being mountable upon any of the first, second, third, and fourth side surfaces.

5. A surface mount inductor as described in claim 4, wherein the multi-turn coil is formed in quarter turn increments, and the plurality of metalized traces are tapped off the vias in quarter turn increments.

6. A surface mount inductor as described in claim 5, further comprising shielding disposed upon the first, second, third, and fourth side surfaces between predetermined portions of the multi-tapped inductor.

7. A surface mount inductor as described in claim 4, wherein said inner substrate layer further comprises:

a plurality of stacked substrate layers disposed between the first and second opposed surfaces, the vias interconnecting the first and second metalization patterns extending through the plurality of stacked substrate layers; and the plurality of metalization traces tapping of vias of the of the multi-turn coil.

8. A surface mount inductor as described in claim 7, further comprising shielding disposed upon the first, second, third, and fourth side surfaces between predetermined portions of the multi-tanned inductor.

9. A surface mount inductor as described in claim 4, wherein the surface mount inductor is capable of being reflowed with high temperature solder.

10. A surface mountable inductor, comprising:

a plurality of substrate layers including at least one inner substrate layer and first and second outer substrate layers, said plurality of substrate layers forming a six sided structure having first and second ends and first, second, third and fourth side surfaces, said at least one inner substrate layer having first and second opposed surfaces;

a first metalization pattern disposed on the first opposed surface of the inner layer the substrate;

a second metalization pattern disposed on the second opposed surface of the at least one inner substrate layer;

plated through-holes located through the at least one inner substrate layer, said plated through-holes interconnecting the first and second metalization patterns to form a multi-turn coil having first and second ends coupled to the first and second ends of the six sided structure;

a tap point disposed onto the at least one inner substrate layer and coupled the multi-turn coil;

a tap element disposed about the first, second, third, and fourth side surfaces between the shielding portion and the first end of the six sided structure, said tap element coupled to said tap point; and a shielding portion disposed about the first, second, third, and fourth side surfaces of the six sided structure between predetermined portions of the tapped elements.

11. A surface mountable inductor as described in claim 10, wherein the first, second, third, and fourth sides have substantially similar dimensions, and the surface mountable inductor is surface mountable upon any of the first, second, third, or fourth sides.

12. A surface mountable inductor as described in claim 10, wherein the plurality of substrate layers comprise layers of a high temperature low loss tangent material.

13. A surface mountable inductor as described in claim 10, wherein the surface mountable inductor is capable of being reflowed with high temperature solder.

14. A surface mountable inductor, comprising:

a plurality of substrate layers including at least one inner substrate layer and first and second outer substrate layers, said plurality of substrate layers forming a six sided structure having first and second ends and first, second, third and fourth sides, said at least one inner substrate layer having top and bottom surfaces;

a first metalization pattern disposed on the top surface of the at least one inner layer the substrate;

a second metalization pattern disposed on the bottom surface of the at least one inner substrate layer;

plated through-holes located through the at least one inner substrate layer, said plated through-holes interconnecting the first and second metalization patterns to form a multi-turn coil, said multi-turn coil being formed in quarter turn increments; and a conductive tap element disposed on at least one of the first, second, third or fourth sides of the six sided structure, said conductive tap element tapping off one quarter turn increment.

15. A surface mountable inductor as described in claim 14, wherein the plurality of substrate layers comprise layers of a high temperature low loss tangent material.

16. A surface mountable inductor as described in claim 14, wherein the surface mountable inductor is capable of being reflowed with high temperature solder.

17. A surface mountable inductor, comprising:

a plurality of substrate layers including at least one inner substrate layer and first and second outer substrate layers, said plurality of substrate layers forming a six sided structure having first and second ends and first, second, third and fourth sides, said at least one inner substrate layer having first and second opposed surfaces;

a first metalization pattern disposed on the first opposed surface of the at least one inner substrate layer;

a second metalization pattern disposed on the second opposed surface of the at least one inner substrate layer;

plated through-holes located on the inner substrate layer, said plated through-holes interconnecting the first and second metalization patterns to form a multi-turn coil; and a first conductive tap element disposed about the first, second, third and fourth sides of the six sided structure, said first conductive tap element coupled to a predetermined increment of the multi-turn coil.

18. A surface mountable inductor as described in claim 17, wherein the multi-turn coil is formed in quarter turn increments and said first conductive tap element taps off a quarter turn increment of the multi-turn coil.

19. A surface mountable inductor as described in claim 18, further comprising a second conductive tap element which taps off a second quarter turn increment of the multi-turn coil.

20. A surface mountable inductor as described in claim 19, further comprising:

a plurality of metallized shields disposed about the first, second, third, and fourth sides of the six sided structure and located in between the first and second conductive tap elements.

21. A surface mountable inductor as described in claim 17, wherein the at least one inner substrate layer comprises a plurality of inner substrate layers coupled between the first and second outer substrate layers, said plurality of inner substrate layers providing increments with which to tap the first conductive tap element.

22. A surface mountable inductor as described in claim 17, wherein the surface mountable inductor is capable of being reflowed with high temperature solder.

23. A surface mountable inductor, comprising:

a plurality of substrate layers including at least one inner substrate layer and first and second outer substrate layers, said plurality of substrate layers forming a six sided structure having first and second ends and first, second, third and fourth sides, said at least one inner substrate layer having first and second opposed surfaces;

a metalization pattern disposed on the first opposed surface of the at least one inner substrate layer;

through-holes plated through the at least one inner substrate layer, said through-holes interconnecting the metalization pattern to said first and second ends; and a conductive tap element disposed about the first, second, third and fourth sides of the six sided structure, said conductive tap element tapping off the metalization pattern, the surface mountable inductor being surface mountable upon any of its first, second, third, and fourth sides.

24. A surface mountable inductor as described in claim 23, wherein the metalization pattern comprises a spiral pattern.

25. A surface mountable inductor as described in claim 24, wherein the surface mountable inductor is capable of being reflowed with high temperature solder.

* * * * *

UNITED STATES PATENT AND TRADEMARK OFFICE

CERTIFICATE OF CORRECTION

PATENT NO. : 5,572,180

DATED : NOVEMBER 5, 1996

INVENTOR(S) : HUANG, ET AL.

It is certified that error appears in the above-indentified patent and that said Letters Patent is hereby corrected as shown below:

Column 11, line 6, delete "of" and insert therefor --off--; delete "of the".

Column 11, line 11, delete "multi-tanned" and insert therefor --multi-tapped--.

Column 11, line 24, after "layer" and before "the" insert --of--.

Column 11, line 34, after "coupled" and before "the" insert --to--.

Column 11, line 63, after "layer" and before "the" insert --of--.

Signed and Sealed this

First Day of April, 1997

*Attest:*

Bruce Lehman

BRUCE LEHMAN

*Attesting Officer*

*Commissioner of Patents and Trademarks*